United States Patent [19]

George et al.

[11] 4,165,725

[45] Aug. 28, 1979

[54] FUEL PUMPING APPARATUS

[75] Inventors: Michael George, Twickenham; Colin P. Brotherston, Banstead; Stanislaw J. A. Sosnowski, London, all of England

[73] Assignee: Lucas Industries Limited, Birmingham, England

[21] Appl. No.: 797,686

[22] Filed: May 17, 1977

[30] Foreign Application Priority Data

May 20, 1976 [GB] United Kingdom ..... 20905/76

[51] Int. Cl.[2] ..... F02M 39/00

[52] U.S. Cl. ..... 123/139 AL; 123/139 BC

[58] Field of Search ..... 123/139 AL, 139 BC

[56] References Cited

U.S. PATENT DOCUMENTS

| | | | |
|---|---|---|---|
| 3,080,818 | 3/1963 | Wirsching | 123/139 AL |
| 3,489,093 | 1/1970 | Thornber | 123/139 AL |

FOREIGN PATENT DOCUMENTS

| | | | |
|---|---|---|---|
| 58781 | 11/1953 | France | 123/139 AL |
| 734279 | 7/1955 | United Kingdom | 123/139 BC |
| 1161691 | 8/1969 | United Kingdom | 123/139 AL |

*Primary Examiner*—Charles T. Jordan

[57] ABSTRACT

A fuel pumping apparatus includes a housing, a rotary distributor member mounted within the housing and a plurality of outlets formed in the housing and communicating in use, with the injection nozzles of an associated engine. The outlets are divided into at least two axially spaced groups and all the outlets are disposed on one side of a plane including the axis of rotation of the distributor member.

2 Claims, 5 Drawing Figures

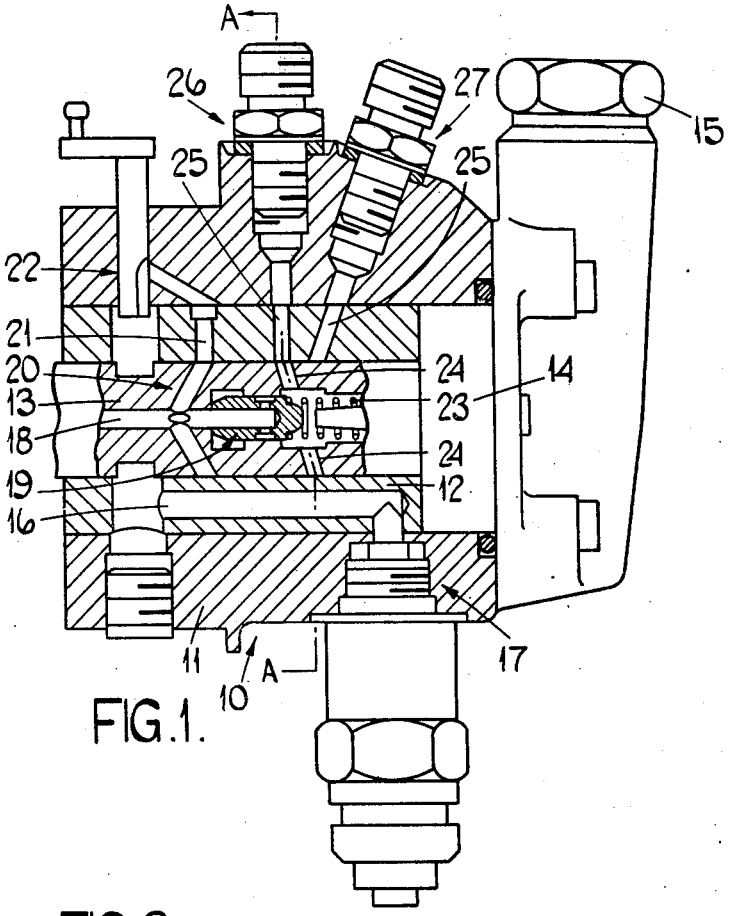
FIG.1.
FIG.2.
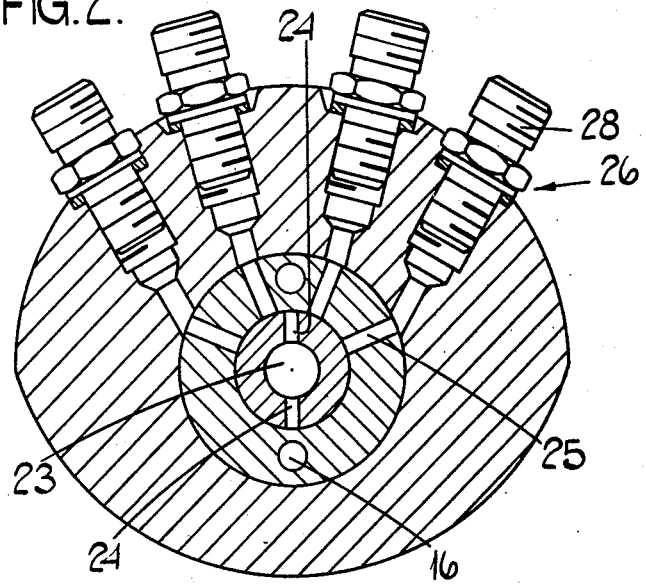

FUEL PUMPING APPARATUS

This invention relates to fuel pumping apparatus for supplying fuel to internal combustion engines and of the kind comprising a housing, a rotary distributor member within the housing, a plurality of outlets formed in the housing and opening onto the periphery of the distributor member, said outlets in use being connected to the injection nozzles of the associated engine and the distributor member having delivery passage means through which fuel is delivered to the outlets in turn as the distributor member rotates.

It is usual in apparatus of the above type to position the outlet ports angularly about the axis of rotation of the distributor member with the delivery passage means comprising a single radial passage. The outlets are connected by passages in the housing to threaded apertures on the periphery of the housing and which in use receive pipe unions. For ease of machining these passages are generally radially disposed so that the apertures are also angularly positioned about the axis of rotation of the distributor member. The disposition of the apertures in this manner raises problems in the installation of the apparatus and it has often been necessary to employ banjo unions or other forms of adaptor to enable the pipelines to extend at least over their initial length, generally parallel to the axis of rotation of the distributor member. The provision of such unions or adaptors means additional fuel tight joints which are susceptible to leakage and there is also the added expense of such unions or adaptors.

The object of the invention is to provide an apparatus of the kind specified in an improved form.

According to the invention, in an apparatus of the kind specified said delivery passage means comprises a plurality of outwardly extending delivery passages formed in the distributor member and breaking out onto the periphery of the distributor member at axially spaced positions, said outlets being divided into a plurality of spaced groups with which the delivery passages register respectively, the outlets being connected to apertures on the periphery of the housing, said apertures being disposed on one side of a plane including the axis of rotation of the distributor member.

One example of a fuel pumping apparatus in accordance with the invention will now be described with reference to the accompanying drawings, in which:

FIG. 1 is a sectional side elevation of the apparatus,

FIG. 2 is a part sectional end elevation on the line A—A of FIG. 1,

Figure 3:
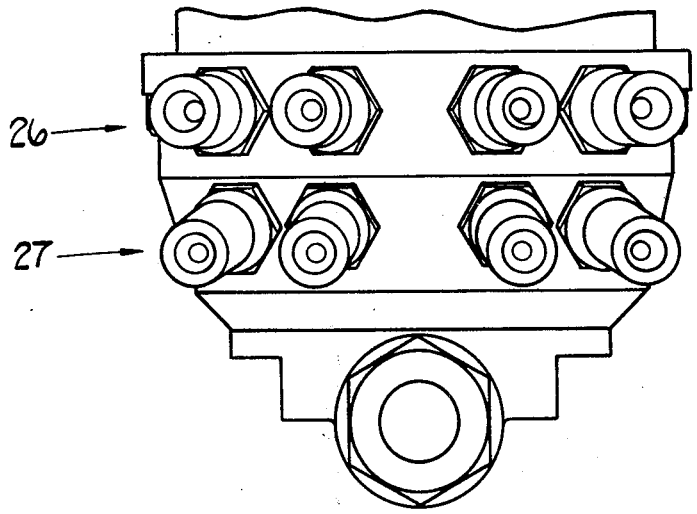
FIG. 3 is a plan view of a portion of the apparatus.

Referring to the drawings, the apparatus comprises a housing generally indicated at 10 and which comprises an outer casing 11 and an inner sleeve 12 located within the casing. The internal peripheral surface of the sleeve 12 forms a bearing surface for a rotary distributor member 13 which in use, is coupled to the associated engine so as to rotate in synchronism therewith. The distributor member is coupled at one end to the rotary part of a fuel feed pump 14 which draws fuel from an inlet 15 and supplies the fuel under pressure to a supply passage 16 formed in the sleeve 12 by way in the particular example, of a solenoid operable valve 17.

The distributor member is provided in known manner, with a transversely extending bore in which is located a pair of pumping plungers. The plungers engage at their outer ends, roller carrying shoes respectively, the rollers of which are engaged during rotation of the distributor member, by cam lobes formed on the internal peripheral surface of an annular cam ring which is mounted within a further portion of the housing. The cam ring together with the rollers and plungers constitute an injection pump which delivers fuel at high pressure to a passage 18 extending longitudinally within the distributor member. The passage communicates with a chamber formed in the distributor member and which houses a delivery valve 19 of known construction and upstream of the delivery valve 19 the passage 18 communicates with a plurality of outwardly extending inlet passages 20 which as the distributor member rotates, register in turn with an inlet port 21 formed within the sleeve 12. The port 21 communicates with the passage 16 by way of a throttle generally indicated at 22 and the arrangement is such that during the filling strokes of the injection pump one of the passages 20 is in register with the port 21 and fuel can flow to the injection pump by way of the passage 18. The amount of fuel which flows is determined in known manner using the throttle valve 22. During the injection stroke the passages 20 are out of register with the inlet port 21 and fuel delivered by the injection pump flows past the delivery valve 19 to a chamber 23 formed in the distributor member and conveniently housing the delivery valve return spring. Extending outwardly from the chamber are a pair of delivery passages 24 and in the particular example, these are diametrically disposed. The delivery passages extend to the periphery of the distributor member and they break out on the periphery of the distributor member at axially spaced positions as best seen in FIG. 1.

Opening onto the periphery of the distributor member are two groups of outlets 25. In the particular example, each group includes four outlets and the two groups of outlets are positioned for registration with the two delivery passages respectively. One delivery passage therefore serves the outlets of one group. The outlets by way of passages are connected to two groups 26, 27 of threaded apertures which are shown in the drawings to have outlet unions 28 located therein. The outlets 25 of the two groups are all positioned on one side of a plane including the axis of rotation of the distributor member and this also applies to the threaded apertures. The angular spacing of the outlets 25 is such in relation to the disposition of the delivery passages 24, that fuel is supplied to an outlet in the particular example, every 45°of rotation of the distributor member so that in the particular example the fuel flows to the outlets of one group in turn and then flows to the outlets of the other group in turn.

By the arrangement described, the threaded apertures and in particular the pipe unions are all disposed on one side of the aforesaid plane and therefore by correctly choosing the plane in relation to the mounting points of the housing relative to the engine structure, it is possible to utilise simple connectors for the pipelines to connect them to the pipe unions. The apparatus as described is also particularly useful for supplying fuel to an engine having two banks of cylinders and in this case, the apparatus can be conveniently located between the two banks of cylinders.

Whilst the apparatus described is intended for supplying fuel to an eight cylinder engine it will be appreciated that it can be modified to provide fuel to a six or a four cylinder engine where similar problems of installation occur. It is only necessary to reposition the outlets to accord with the timing of injection required. Moreover, it will be noted from FIG. 3 that the pipe unions and threaded apertures are axially aligned in pairs. The pipe unions and apertures could be staggered in the circumferential direction if so desired. This could be achieved by drilling the portions of the passages forming the outlets at different angles whilst ensuring that the outlets break out onto the periphery of the distributor member at the same points. Alternatively, the disposition of the two delivery passages can be altered so as to allow one of the groups of pipe unions and threaded apertures to be moved angularly relative to the other.

It is also possible to provide the apparatus in a form in which the passages which are drilled in the casing 11 are identical for eight, six or four cylinder application. In these cases the apertures which are not required would merely be blocked off. In such an arrangement modification of the drilling of the sleeve 12 would be required to ensure the correct timing and it would be possible to form slots on the periphery of the sleeve so that the outlets 25 could be correctly positioned and in communication with the appropriate threaded aperture.

For a twelve cylinder application a further delivery passage or passages would be required. Again however the outlets would be divided into groups equal in number to the number of delivery passages.

The use of two or more delivery passages enables pressure balancing of the distributor member to be achieved, as compared with an apparatus in which only one delivery passage is provided. Moreover, fuel flow takes place through the delivery passages so they are self cleaning and there should be no accumulation of dirt within the passages. This is contrary to the situation which prevails in an apparatus with one delivery passage where in order to achieve pressure balancing dummy passages or grooves are provided through which no fuel flow occurs.

Figure 4:
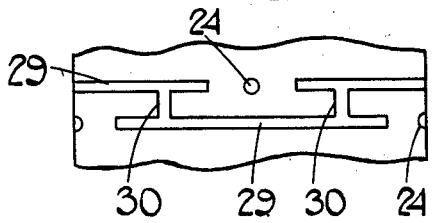
FIG. 4 is a developed view of a modified portion of the apparatus.
Figure 5:
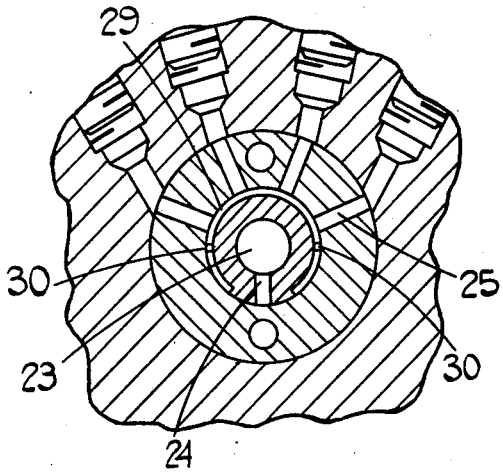
FIG. 5 is a view similar to FIG. 2 but showing the modification.

In FIGS. 4 and 5 there is shown a modification which further assists the pressure balancing of the distributor member and also ensures that the residual pressures in the pipelines which connect the apparatus to the injection nozzles of the associated engine are equalised.

With reference to these FIGS., there is formed on the periphery of the distributor member a pair of grooves 29 the axial spacing of which is the same as the spacing of the delivery passages 25.

The grooves are not complete and whilst they extend in a circumferential direction the ends of the grooves are arranged to subtend an angle measured relative to the axis of rotation of the distributor member, equal to the angle subtended by alternate outlets 25. The respective delivery passage opens onto the periphery of the distributor member midway between the ends of the grooves and the arrangement is such that when a delivery passage is in register with one outlet 25, the other outlets of the group will be in communication with each other by way of the associated groove. The two grooves 29 are interconnected by axial grooves 30 so that all the outlets of the apparatus which are not in communication with a delivery passage will be in communication with each other. A complete balance of the radial forces acting on the distributor member is therefore obtained and the residual pressures in the pipelines are equal.

We claim:

1. A fuel pumping apparatus for supplying fuel to internal combustion engines comprising a housing, a rotary distributor member within the housing, a plurality of outlets formed in the housing and opening onto the periphery of the distributor member, said outlets, in use, being connected to the injection nozzles of the associated engine, the distributor member having delivery passage means substantially equiangularly spaced about the periphery of the distributor member through which fuel is delivered to the outlets in turn as the distributor member rotates, said delivery passage means comprising a plurality of outwardly extending delivery passages found in the distributor member and breaking out onto the periphery of the distributor member at axially spaced positions, said outlets being divided into a plurality of spaced groups with which the delivery passages register respectively, the outlets being connected to apertures on the periphery of the housing, said apertures and outlets being disposed on one side of a plane including the axis of rotation of the distributor member, and there is formed in the periphery of the distributor member a plurality of discontinuous circumferential grooves which are aligned with the delivery passages respectively, the delivery passages being disposed between the ends of the respective grooves, the angles subtended by the ends of the grooves being substantially equal to the angle between alternate outlets.

2. An apparatus according to claim 1 in which said circumferential grooves are in communication with each other by way of axial grooves on the distributor member whereby when a delivery passage is in register with one outlet the remaining outlets will be in communication with each other.

* * * * *